US006755136B2

(12) United States Patent
Jenkins

(10) Patent No.: US 6,755,136 B2
(45) Date of Patent: Jun. 29, 2004

(54) CARRIAGE ROLLER ADJUSTING MECHANISM FOR STAIRLIFTS

(75) Inventor: Martyn Harry Jenkins, Salisbury (GB)

(73) Assignee: Stannah Stairlifts Limited, Hampshire (GB)

( * ) Notice: Subject to any disclaimer, the term of this patent is extended or adjusted under 35 U.S.C. 154(b) by 33 days.

(21) Appl. No.: 10/181,670

(22) PCT Filed: Jan. 19, 2001

(86) PCT No.: PCT/GB01/00224

§ 371 (c)(1),
(2), (4) Date: Jul. 17, 2002

(87) PCT Pub. No.: WO01/53188

PCT Pub. Date: Jul. 26, 2001

(65) Prior Publication Data

US 2003/0029352 A1 Feb. 13, 2003

(30) Foreign Application Priority Data

Jan. 20, 2000 (GB) ..... 0001249

(51) Int. Cl.[7] ..... B61B 13/04
(52) U.S. Cl. ..... 105/141
(58) Field of Search ..... 104/118, 119; 105/141, 142, 148, 149.2, 150, 154, 155

(56) References Cited

U.S. PATENT DOCUMENTS

| | | | | |
|---|---|---|---|---|
| 3,902,432 A | * | 9/1975 | Shortridge et al. | 105/150 |
| 4,602,567 A | | 7/1986 | Hedstrom | |
| 5,653,172 A | * | 8/1997 | Roschier | 104/93 |
| 6,360,673 B1 | * | 3/2002 | Herrin et al. | 105/141 |

FOREIGN PATENT DOCUMENTS

| | | |
|---|---|---|
| BE | 1007308 A6 | 5/1995 |
| EP | 0343264 A1 | 11/1989 |
| WO | WO 99/43594 A1 | 9/1999 |

* cited by examiner

*Primary Examiner*—S. Joseph Morano
*Assistant Examiner*—Robert J. McCarry, Jr.
(74) *Attorney, Agent, or Firm*—Edwin D. Schindler

(57) ABSTRACT

An apparatus for adjusting the rollers of a stairlift carriage, for ensuring that the carriage is firmly located on a stairlift rail, includes rollers for engaging one side of the stairlift rail, as well as rollers located on an opposite side of the rail, such that the stairlift rail is located between opposed sets of rollers. To achieve adjustment, the rollers on one side of the rail are located on a common member, which can be displaced toward and away from the stairlift rail.

6 Claims, 3 Drawing Sheets

CARRIAGE ROLLER ADJUSTING MECHANISM FOR STAIRLIFTS

FIELD OF THE INVENTION

This invention relates to stair mounted elevators or lifts, commonly known as stairlifts.

BACKGROUND

Stairlifts, in the form of a carriage mounted for movement along a rail, are well known for moving aged or handicapped persons up and down staircases.

In our pending International Patent Application PCT/GB99/03447 we describe and claim a form of stairlift in which the stairlift carriage is supported on a narrow tubular rail including four rolling surfaces arranged about the rail cross-section at 45° to a horizontal plane through the rail. To this end, the carriage includes roller pairs which bear on the rolling surfaces extending along the rail, and the above application describes how these rollers are provided in upper and lower pairs. The pending application further describes the use of axle pins mounted in eccentric through bores in the lower rollers which allows adjustment of the lower rollers to take up unwanted play between the carriage and the rail.

In practice, we have found that the particular rail and carriage configuration does not best lend itself to adjustment in the manner described. Further, accessing and manipulating the eccentric mounts of the lower rollers can be difficult for an installer.

It is an object of this invention to provide a stairlift which allows adjustment in installation and/or operation which addresses the aforementioned problems, or which will at least provides a useful choice.

SUMMARY OF THE INVENTION

Accordingly, in one aspect, the invention provides a stairlift carriage for movement along a stairlift rail, said carriage including:

a plurality of first rollers arranged to engage said rail from a first direction;

a plurality of second rollers arranged to engage said rail from a second direction, said second direction being substantially opposed to said first direction; and adjustment means operable to adjust the spacing between at some of said first rollers and said second rollers, said carriage being characterised in that said adjustment means includes a common member on which at least two of said first rollers are mounted and displacement means operable to displace said common member towards said second rollers.

Preferably all of said first rollers are mounted on said common member.

Preferably said carriage further includes a spaced pair of side plates which, when said carriage is in its normal operating position, overlie opposite sides of said rail, wherein said rollers are mounted to project inwardly from said side plates.

Preferably said displacement means is operable to displace said common member with respect to the side plate from which said first rollers project. Said displacement means conveniently comprises one or more grub screws, each grub screw being mounted in a stud fixed to said side plate.

In a second aspect the invention provides a stairlift including the carriage as herein before set forth.

Many variations in the way the present invention may be performed will present themselves to those skilled in the art. The description which follows is intended as an illustration only and the absence of description of particular alternatives or variants should in no way be applied to limit the scope of the invention. Such description of specific elements which follows should also be interpreted as including equivalents whether existing now or in the future. The scope of the invention should be defined solely by the appended claims.

BRIEF DESCRIPTION OF THE DRAWINGS

One form of stairlift carriage incorporating the invention will now be described with reference to the accompanying drawings in which.

DESCRIPTION OF WORKING EMBODIMENT

Figure 1:
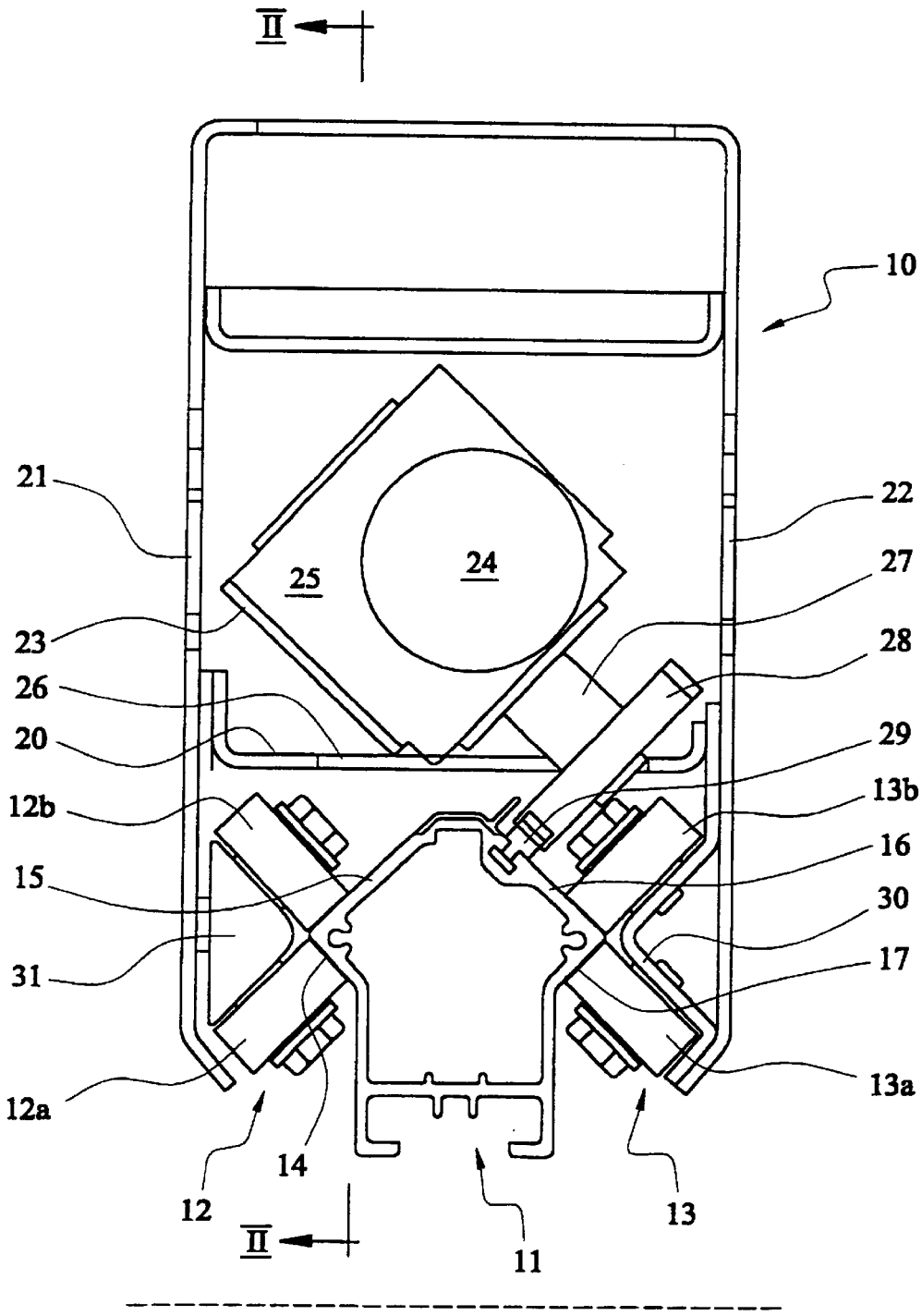
FIG. 1: Shows an end sectional view of a stairlift carriage incorporating the invention mounted on a stairlift rail.

Referring firstly to FIG. 1, the present invention provides a stairlift carriage 10 mounted substantially above, for movement along, a tubular rail 11 of constant cross section. The carriage is supported on the rail by a first roller set 12 and a second roller set 13 and it will be appreciated that the roller sets 12 and 13 engage opposite sides of the rail and from substantially opposite directions.

The rail and roller configuration is such as to permit smooth movement of the carriage longitudinally of the rail yet prevent tilting, skewing and rotation of the carriage about the rail.

Figure 2:
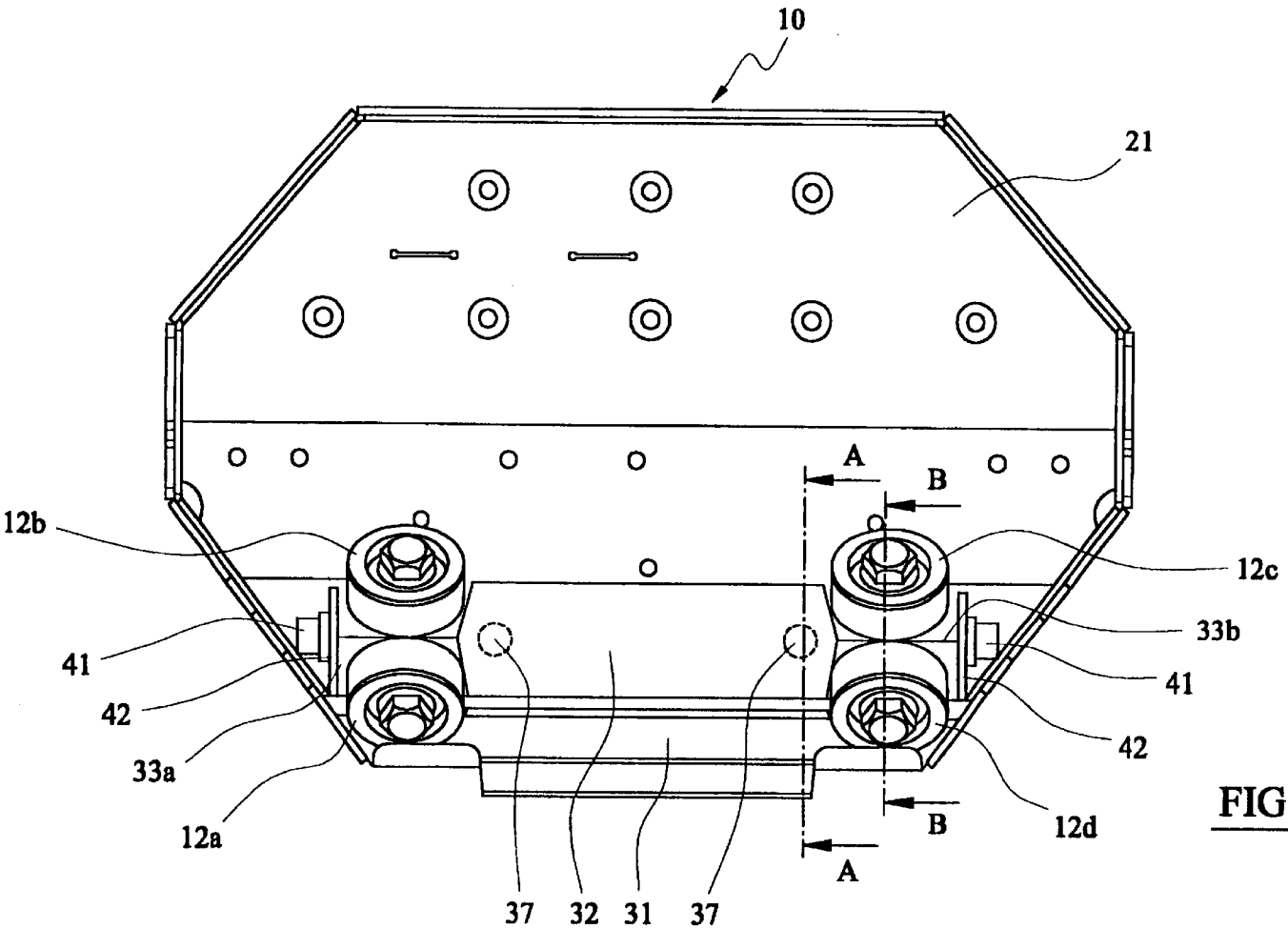
FIG. 2: Shows, in a smaller scale, a view along the line II—II in FIG. 1 with certain components omitted for clarity.

In the form shown, each of the roller sets 12 and 13 comprises four rollers, the first set 12 being shown in entirety in FIG. 2 and comprising individual roller pairs 12*a*, 12*b* and 12*c* and 12*d*, the rollers 12*c* and 12*d* being mounted to engage the rail at a position longitudinally spaced from that engaged by the rollers 12*a* and 12*b*.

The roller set 13 is a mirror of the roller set 12.

In accordance with conventional practice, the rail 11 has a plurality of rolling surfaces 14, 15, 16 and 17 for rolling engagement by the roller sets 12 and 13. As can be seen, the rolling surfaces are arranged about the cross section of the tubular rail, extend longitudinally of the rail 11 and are formed by the same elements that define the structural elements of the tube. This leads to a compact and structurally efficient rail.

In the form shown, rollers 12*a* and 12*d* engage rolling surface 14, rollers 12*b* and 12*c* engage rolling surface 15, rollers 13*b* and 13*c* engage rolling surface 16 and rollers 13*a* and 13*d* engage rolling surface 17.

As shown, the carriage 10 further includes a main chassis 20 which, when the carriage is mounted in position on the rail 11, spans over the rail. Mounted at spaced points on the chassis 20, preferably along opposite edges of the chassis, are side plates 21 and 22 which extend down to overlie at least part of both sides of the rail 11. As will be described in greater detail below, the side plates also serve as mountings for the roller sets 12 and 13.

Included on the chassis 20 is a mounting base 23 which is angled to the remainder of the chassis and serves as a mounting surface for main drive motor 24 and gearbox 25. The chassis 20 further includes a central aperture 26. This gives clearance to enable drive pinion 28, mounted on output shaft 27 of gearbox 25, to engage with drive rack 29 located below the chassis 20 on rail 11. Rotation of the pinion 28 causes the carriage 10 to be displaced along the rail 11.

The lower part of side plate 22 is preferably provided with an internal triangulated bracing member 30, the bracing member extending along the carriage and adding considerable stiffness to that section of the carriage which provides the mount to the rail 11. As can be seen, the bracing member also provides convenient mounting points for the second rollers 13. Indeed, the configuration of bracing which provides significant natural strength—a triangle—also perfectly positions the rollers 13*a*, 13*b*, 13*c* and 13*d* to engage the perpendicular rolling surfaces 16 and 17 of the rail 11.

In order to provide adjustment between the rollers 12, 13 and the rail 11, the first rollers 12 are mounted for movement toward and away from the rollers 13. To this end, at least some, and preferably all, of the rollers 12 are mounted on a common member or bogie 31 which, in turn, is mounted on the inner surface of side plate 21 for movement toward and away from the side plate 21 and away from and toward the roller set 13.

Figure 4:
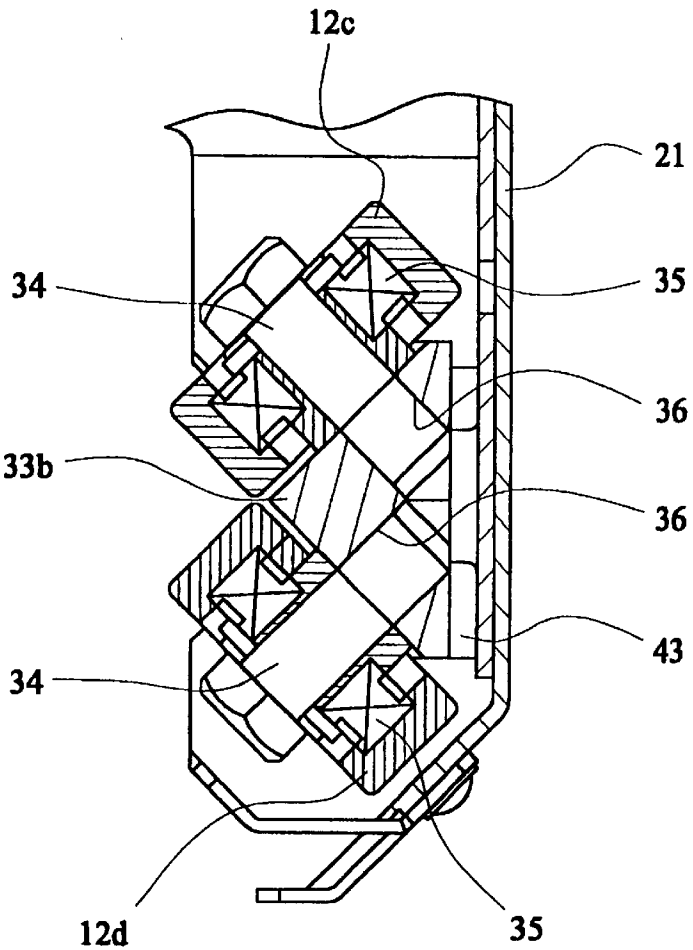
FIG. 4: Shows, in a larger scale than FIG. 2, a view along the line B—B in FIG. 2.
Figure 3:
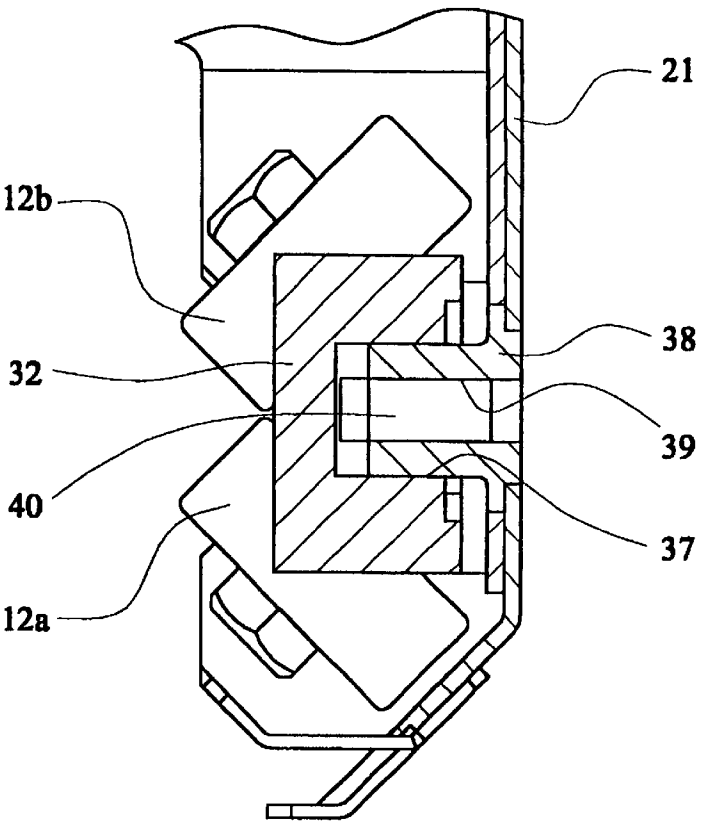
FIG. 3: Shows, in a larger scale than FIG. 2, a view along the line A—A in FIG. 2.

Referring now to FIGS. 2 to 4, the bogie 31 has a solid centre section 32 of rectangular cross-section and two end sections 33*a* and 33*b* of triangular section, the rollers 12 being mounted on the end sections 33*a*, 33*b* so as to mirror the configuration of the rollers 13. As can be seen from FIG. 4, each of the rollers 12 (and indeed each of the rollers 13) is mounted on an axle pin 34 via a roller bearing 35. Each axle pin 34 is screwed into threaded bores 36 provided in end sections 33 of bogie 31.

Referring now to FIG. 3, the centre section 32 of bogie 31 includes a pair of spaced bores 37 which slidingly receive a pair of studs 38 fixed to, and projecting inwardly from, the side plate 21. Screw fitted into a central bore 39 in each stud 38 is a grub screw 40 and it will be appreciated that as the grub screws 40 are screwed into bores 39, the bogie 31 is displaced away from the inner surface of side plate 21. Simultaneously, the rollers 12 are displaced toward the rollers 13 to more firmly clamp the carriage 10 onto rail 11.

Once the desired roller adjustment has been achieved, the bogie 31 may be locked in place by locking bolts 41 (FIG. 2) which pass through end tabs 42 of a fixing plate 43 fixed to side plate 21, and engage in bores drilled in the end faces of the end sections 33*a* and 33*b*.

Although the bogie 31 has been described as a single component, it could be provided in two parts with one pair of rollers on each part.

In use, the installer sets the carriage 10 on the rail 11 which he has previously mounted on the stair. The carriage is preferably mounted so that the side plate 22 is adjacent one wall defining the stairway and the side plate 21 is on the outside of the installation. The installer can then tighten the carriage 10 on the rail 11 by inserting an Allen key into each bore 39 in turn and causing bogie 31 to be displaced away from side plate 21 until the rollers pairs 12 and 13 are firmly yet rotatably engaged with opposite sides of the rail 11. Once the bogie 31 has been positioned correctly, the installer tightens bolts 41 to lock the bogie with respect to the side plate 21.

It will thus be appreciated that the present invention, at least in the case of the embodiment thereof described above, provides a simple yet effective means of providing for roller adjustment to be effected on a stairlift installation from a position easily accessed by an installer.

What is claimed is:

1. A stairlift carriage for movement along a stairlift rail, said stairlift carriage comprising:

a plurality of first rollers arranged for engaging a stairlift rail from a first direction;

a plurality of second rollers arranged for engaging said stairlift rail from a second direction, said second direction being substantially opposite to said first direction; and, means for adjusting a spacing between at least some of said plurality of first rollers and said plurality of second rollers, said means for adjusting including:

a common member on which at least two of said plurality of first rollers are mounted; and, means for displacing said common member toward said plurality of second rollers.

2. The stairlift carriage for movement along a stairlift rail according to claim 1, wherein all of said plurality of first rollers are mounted on said common member.

3. The stairlift carriage for movement along a stairlift rail according to claim 1, further comprising a spaced pair of side plates overlying opposite sides of said stairlift rail when said stairlift carriage is in its operating position, said plurality of first rollers and said plurality of second rollers being mounted for projecting inwardly from said spaced pair of side plates.

4. The stairlift carriage for movement along a stairlift rail according to claim 3, wherein said means for displacing said common member displaces said common member relative to one side plate of said spaced pair of side plates from which said plurality of first rollers project.

5. The stairlift carriage for movement along a stairlift rail according to claim 4, where in said means for displacing said common member includes at least one grub screw mounted in a stud fixed to said one side plate.

6. A stairlift, comprising:

a stairlift rail; and, a carriage for movement along said stairlift rail, said carriage including:

a plurality of first rollers arranged for engaging said stairlift rail from a first direction;

a plurality of second rollers arranged for engaging said stairlift rail from a second direction, said second direction being substantially opposite to said first direction; and, means for adjusting a spacing between at least some of said plurality of first rollers and said plurality of second rollers, said means for adjusting including:

a common member on which at least two of said plurality of first rollers are mounted; and, means for displacing said common member toward said plurality of second rollers.

* * * * *